US008640365B2

(12) United States Patent
Kueper

(10) Patent No.: US 8,640,365 B2
(45) Date of Patent: Feb. 4, 2014

(54) CLEARING STRIP FOR THE BLADE OF A SNOWPLOW

(75) Inventor: Roland Kueper, Bochum (DE)

(73) Assignee: Kueper GmbH & Co. KG, Bochum (DE)

( * ) Notice: Subject to any disclaimer, the term of this patent is extended or adjusted under 35 U.S.C. 154(b) by 0 days.

(21) Appl. No.: 13/505,557

(22) PCT Filed: Oct. 19, 2010

(86) PCT No.: PCT/EP2010/006374

§ 371 (c)(1),
(2), (4) Date: Jul. 18, 2012

(87) PCT Pub. No.: WO2011/054443

PCT Pub. Date: May 12, 2011

(65) Prior Publication Data

US 2012/0279092 A1 Nov. 8, 2012

(30) Foreign Application Priority Data

Nov. 3, 2009 (DE) ..... 10 2009 051 751

(51) Int. Cl.
*E01H 5/04* (2006.01)

(52) U.S. Cl.
USPC ..... 37/233; 37/266

(58) Field of Classification Search
USPC ..... 37/233, 266, 407, 460; 172/701.3
See application file for complete search history.

(56) References Cited

U.S. PATENT DOCUMENTS

| | | | | | |
|---|---|---|---|---|---|
| 520,479 | A * | 5/1894 | Bunnell | 172/701.3 |
| 2,061,585 | A * | 11/1936 | Meyer | 37/233 |
| 4,288,932 | A * | 9/1981 | Kuper | 37/233 |
| 4,347,677 | A * | 9/1982 | Kuper | 37/233 |
| 4,651,450 | A * | 3/1987 | York et al. | 37/197 |
| 5,136,795 | A * | 8/1992 | Rosenberg | 37/233 |
| 5,140,763 | A * | 8/1992 | Nichols, IV | 37/233 |
| 5,471,770 | A * | 12/1995 | Ferreira | 37/264 |
| 5,611,157 | A * | 3/1997 | Ferreira | 37/449 |
| 5,743,032 | A * | 4/1998 | Vauhkonen | 37/446 |
| 6,125,559 | A * | 10/2000 | Mullenhour | 37/232 |
| 7,467,485 | B2 * | 12/2008 | Lachance et al. | 37/232 |
| 7,765,726 | B2 * | 8/2010 | Kuper | 37/460 |
| 7,874,085 | B1 * | 1/2011 | Winter et al. | 37/270 |
| 7,905,035 | B2 * | 3/2011 | Thomas | 37/266 |
| 7,975,408 | B2 * | 7/2011 | Mishra et al. | 37/231 |
| 2001/0005949 | A1 * | 7/2001 | Amano et al. | 37/381 |
| 2003/0182824 | A1 * | 10/2003 | Coffin et al. | 37/266 |
| 2007/0193755 | A1 * | 8/2007 | Kuper | 172/701.3 |

FOREIGN PATENT DOCUMENTS

| | | |
|---|---|---|
| DE | 29 04 251 | 8/1980 |
| WO | WO 94/17248 | 8/1994 |
| WO | WO 2005/124031 | 12/2005 |

* cited by examiner

*Primary Examiner* — Thomas B Will
*Assistant Examiner* — Joan D Misa
(74) *Attorney, Agent, or Firm* — Collard & Roe, P.C.

(57) ABSTRACT

The invention relates to a clearing strip for the blade of a snowplow, the clearing strip having a steel fastening neck (1) and a rubber body (4) which is vulcanized onto the fastening neck (1) and is reinforced on its outer face by steel plates. The outer faces of the rubber body (4) are reinforced by means of large surface-area, rigid steel plates either on one side or on both sides. The steel plates fastened to the outer surface of the rubber body (4) are divided into separate steel segments (3) that are arranged adjacent each other and together form a uniform clearing edge close to the ground.

9 Claims, 3 Drawing Sheets

CLEARING STRIP FOR THE BLADE OF A SNOWPLOW

CROSS REFERENCE TO RELATED APPLICATIONS

Figure 1:
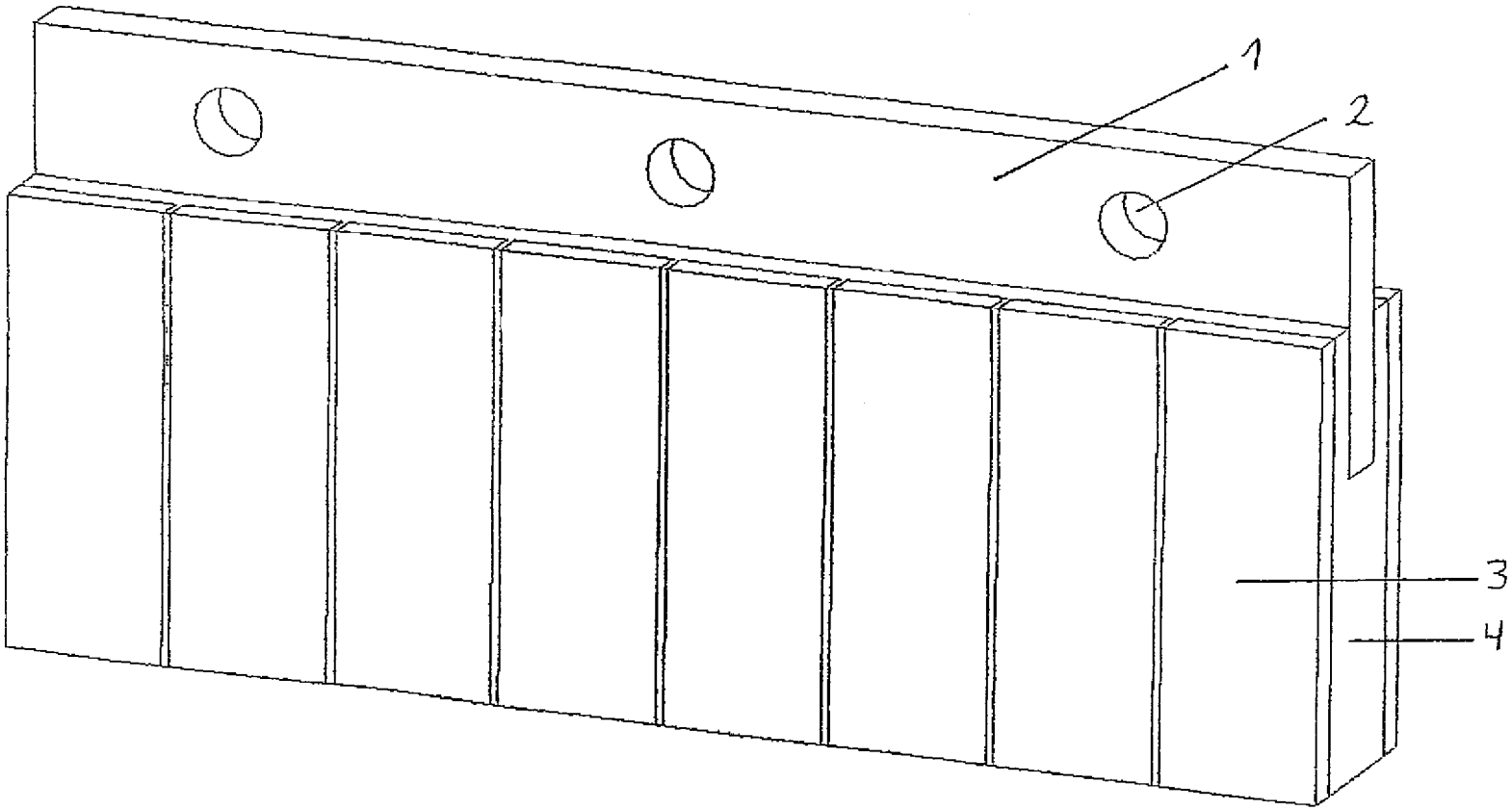

This application is the National Stage of PCT/EP2010/006374 filed on Oct. 19, 2010, which claims priority under 35 U.S.C. §119 of German Application No. 10 2009 051 751.0 filed on Nov. 3, 2009, the disclosure of which is incorporated by reference. The international application under PCT article 21(2) was not published in English.

The invention relates to a clearing strip for the clearing blade of a snowplow, whereby the clearing strip has a steel attachment neck and a rubber body vulcanized onto the attachment neck, which body is reinforced on its outside by steel plates.

Clearing strips of the type indicated are known in the state of the art, in different embodiments. The outside of the rubber body is reinforced, on one side or on both sides, with rigid steel plates that cover a large area. However, there are problems with this reinforcement of the rubber body with a rigid steel surface as the front surface, in that when there are uneven areas in the road surface, for example lane grooves or defective repairs, for example, the clearing strip either does not clear uniformly or causes damage to these objects, because of the inelastic steel plate. In the state of the art, solutions are therefore known, for example in DE 29 04 251 C2, which provide for reinforcement by means of steel plates only for the lower region of the rubber body, which stands in contact with the road. Above this reinforcement, the forces that engage can be converted into deformation or bending of the rubber body, and thus bring about a deflection movement of the clearing strip.

However, the problem remains that in the case of irregularities in the road surface, the forces to be applied for deformation of the rubber body and the mass forces to be overcome for rapid movement of the heavy steel plate are significantly greater than the forces that counter them on the part of the obstacle. This inevitably leads to destruction of the obstacle. On the other hand, the problem has not been solved that a rigid steel front does not uniformly clear non-uniform roadways, such as roadways having lane grooves, because it only makes contact with the highest points of the surface.

It is therefore the task of the invention to create a clearing strip that effectively and uniformly clears the road of snow and ice, and, at the same time, is deflected by or follows the uneven areas of the road, without damaging them.

To accomplish this task, the invention proposes, proceeding from the state of the art as described above, that the steel plates attached to the outer surface of the rubber body are divided into separate steel segments disposed next to one another, which segments together form a uniform clearing edge close to the ground.

The solid steel edge of the clearing strip is interrupted by means of disposing individual smaller steel segments next to one another. Thus, each steel segment can move flexibly and independent of the other segments, within certain limits, without the entire clearing strip having to be bent up and/or back when it impacts an obstacle. In this way, the mass forces to be overcome are also reduced essentially to the mass forces of the individual steel segments.

It is practical if the steel segments are vulcanized onto the rubber body. In this way, a durable bond between the steel segments and the rubber body is guaranteed, so that even under great stress on the steel segments, these cannot fall off the clearing strip and endanger other road users, in the worst case.

The invention furthermore provides that the steel segments extend, on the front side and the back side of the rubber body, over its entire height, and that the steel attachment neck extends all the way into the region between the front and the back steel segments, and is vulcanized into the rubber body at a distance from them. This embodiment allows a particularly stable structure of the clearing strip and therefore also makes it possible to handle even the most difficult clearing work. A large volume of snow can be pushed by the clearing strip by means of the most comprehensive coverage possible of the rubber body with steel segments, and by means of the placement of the attachment neck all the way into the region between the steel segments, without the strip being subject to deformation beyond the elastic range and thereby suffering damage.

It is practical if the rubber body is configured to be rectangular in cross-section. With regard to production, this is the simplest and most cost-advantageous variant.

An advantageous embodiment of the clearing strip provides that the rubber body is trapezoid in cross-section, with a cross-section that widens from top to bottom. By means of this trapezoid widening, the volume of the rubber body increases in the direction of the clearing edge. This leads to greater rigidity of the rubber body, particularly there where the greatest mass of snow engages, and to lesser rigidity where the forces that proceed from the local obstacles of the road surface engage.

An embodiment of the invention provides that the rubber body has at least two rubber mixtures having different hardness. It is practical if the rubber mixture close to the ground in the vertical direction is harder than facing away from the ground. In this way, the flexibility of the clearing strip can be adapted to the stress, in each instance. Thus, for example, a better clearing effect of the clearing strip is obtained by means of a harder rubber mixture close to the ground. Also, a continuous increase in hardness over the height of the clearing strip is also possible.

In the sense of the invention, it is provided that the rubber body has at least one cavity. This cavity, or even multiple individual cavities, serve as a buffer space for the displaced material of the rubber body when it impacts an obstacle. Likewise, a cavity facilitates deformation of the rubber body at the corresponding location. The cavities can be used in any desired arrangement within the rubber body, whereby placement particularly at the locations subject to the greatest stress is recommended.

It is particularly recommended that the cavity runs in the rubber body below the lower edge of the steel attachment neck and parallel to it. The region under the attachment neck embedded in the rubber body is exposed to deformations to a particular degree. By means of these deformations, the material of the rubber body is displaced, and this leads to local compression. If a cavity is now placed precisely there, the displaced, compressed material can be relieved of stress.

Likewise, the at least one cavity in the rubber body 4 can also run vertically. In this way, the rigidity of the clearing strip can be varied in the horizontal direction.

Additionally, it is recommended that the cavity has a circular or oval cross-section and extends over the entire length or height of the rubber body. In this connection, extending the cavity over the entire length guarantees uniform elasticity of the clearing strip. The geometrical cross-sectional shape of a circle or oval is furthermore very stable, because in contrast to a rectangle, for example, it does not have any corners, which can easily tear when subjected to stress.

A particularly advantageous configuration of the cavity within the clearing strip is obtained if the cavity is formed by a tubular section embedded in the rubber body. This is particularly advantageous with regard to production of the clearing strip, because a conventional tubular section can be cast into the rubber body and therefore subsequent working of the rubber body is eliminated. Otherwise, it would be necessary to drill cavities into the rubber body after the rubber body is cast.

Figure 2:
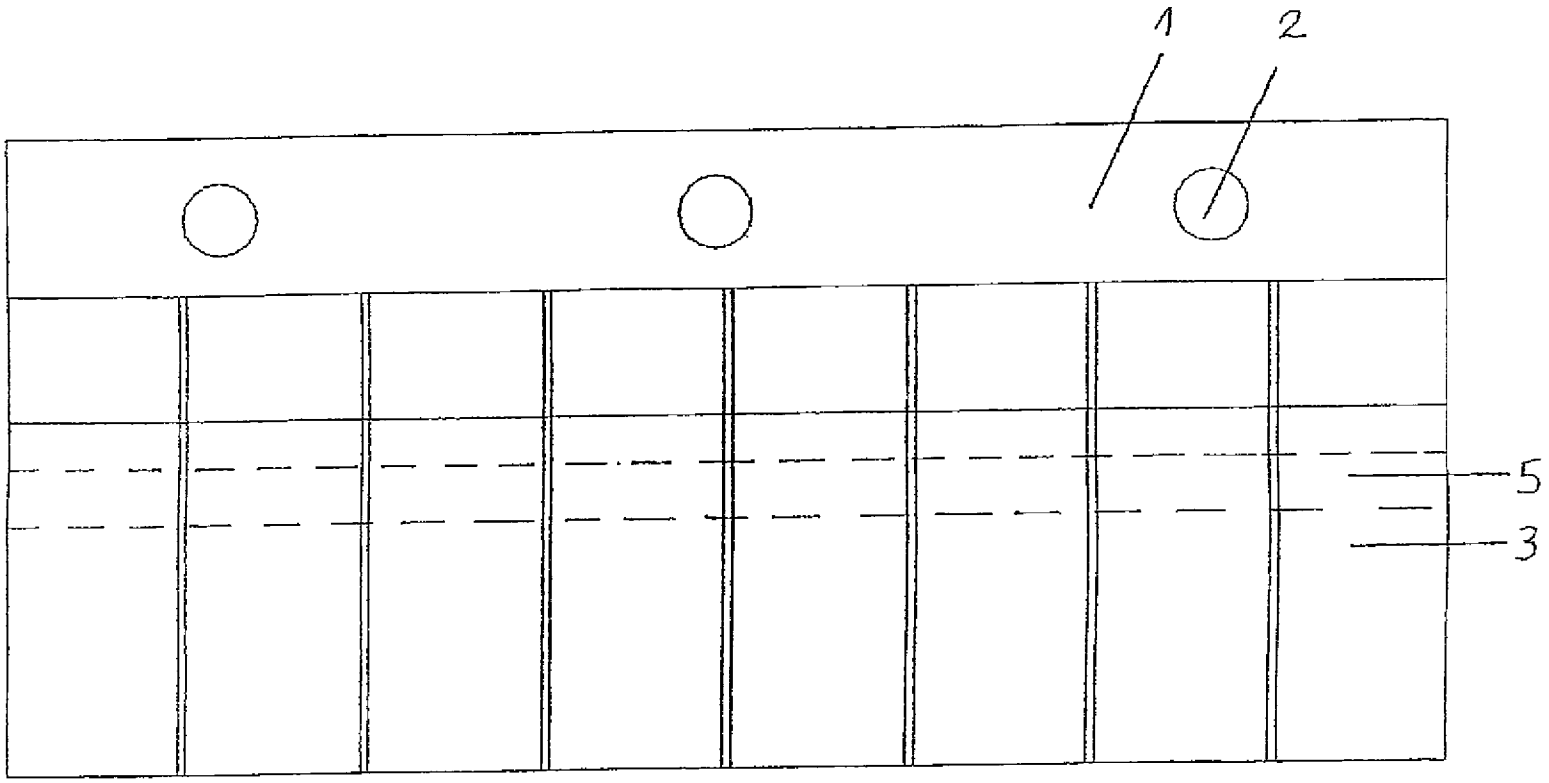
Figure 4:
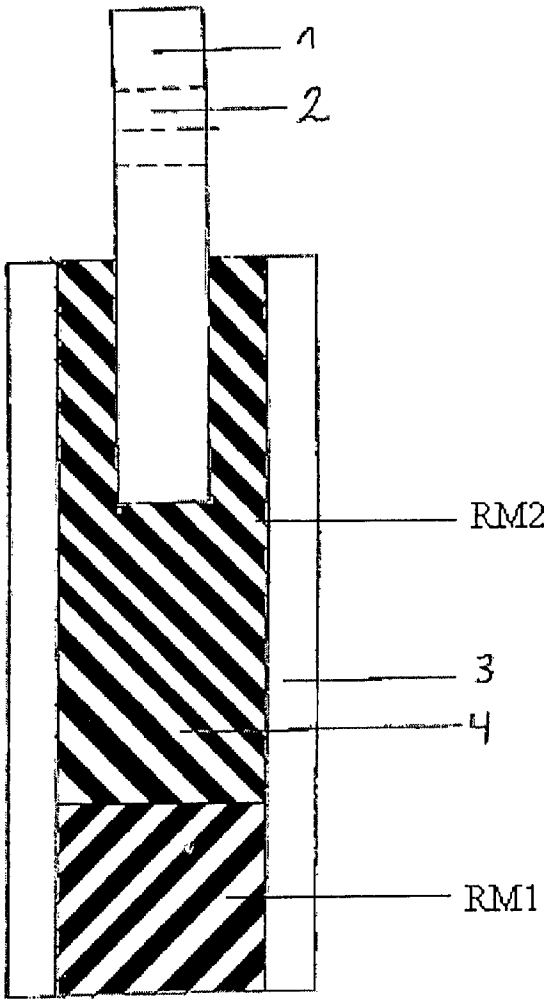
Figure 3:
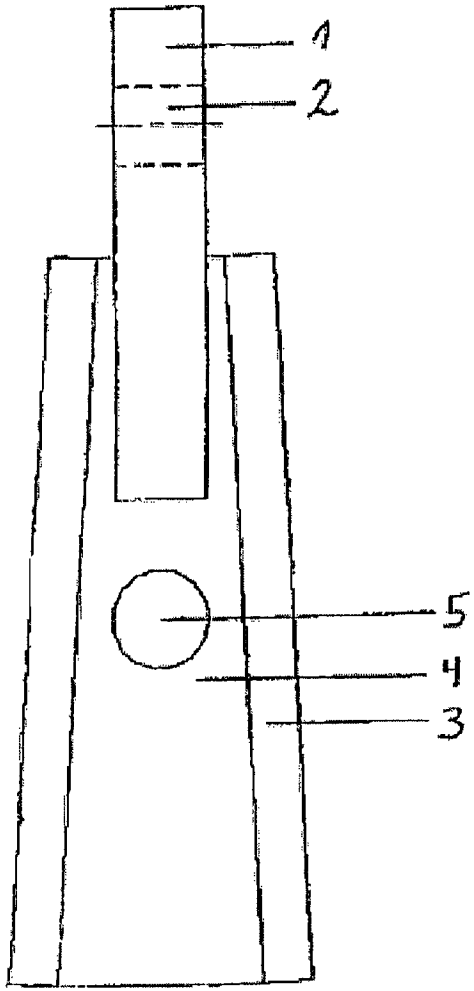

An exemplary embodiment of the invention will be explained in greater detail below, using the drawings. These show:

FIG. 1: clearing strip in a 3D view;

FIG. 2: front view of a clearing strip;

FIG. 3: side view of a clearing strip having a conical cross-sectional surface;

FIG. 4: side view of a clearing strip having a rectangular cross-sectional surface.

In FIGS. 1 and 2, a clearing strip is schematically shown, which carries passage holes 2 on an attachment neck 1, for affixation to a clearing blade of a snowplow. A clearing edge of the clearing strip close to the ground has multiple steel segments 3 disposed next to one another, which are vulcanized onto a rubber body 4 that lies behind them. FIG. 3 shows a side view of the clearing strip having a conical cross-sectional surface. The attachment neck 1, onto which the rubber body 4 is vulcanized, is situated in the center of the clearing strip. The rubber body 4 carries the individual steel segments 3 on its surface. A tubular cavity 5 is shown within the rubber body 4; this cavity passes through the entire width of the rubber body 4. In FIG. 4, a side view of a clearing strip having a rectangular cross-sectional surface is shown. Rubber body 4 has at least two rubber mixtures RM1 and RM2 having different hardness. Rubber mixture RM1 which is close to the ground in the vertical direction is harder than rubber mixture RM2 facing away from the around.

The invention functions in such a manner that the clearing strip is attached to the clearing blade of a snowplow using the passage holes 2. As the snowplow moves over a snow-covered surface, the snow is pressed against the steel segments 3. In the case of uniform stress on the clearing strip, the rubber body 4 is pushed uniformly upward and/or backward. In this case, the tubular section 5 that lies in the interior of the rubber body 4 is uniformly deformed by the displaced material.

When the clearing strip impacts a small obstacle that projects from the ground only locally, only one steel segment 3 or only a few steel segments 3 are affected, depending on the size of the obstacle. When the obstacle impacts each individual steel segment 3 affected, this segment is at first pressed upward and/or backward, together with the partial region of the rubber body 4 that lies behind it. In this connection, as the rubber body 4 is deformed, the cavity 5 is used to accommodate the displaced rubber 4. Except for the directly adjacent segments 3, the other steel segments 3, farther away from the obstacle, remain uninfluenced and can continue to clear the snow from the road.

In the case of a roadway covered with lane grooves, individual steel segments 3, together with the partial region of the rubber body 4 that lies behind them, penetrate into the regions of the road that lie lower down, while the steel segments 3 that are not affected remain at the level of the remainder of the street surface.

Thus, effective clearing of a road with height differences of the surface is possible.

The invention claimed is:

1. A clearing strip for the clearing blade of a snowplow, wherein the clearing strip has a steel attachment neck and a rubber body vulcanized onto the attachment neck, wherein said rubber body is reinforced on an outer surface of said rubber body by steel plates, wherein the steel plates attached to the outer surface of the rubber body are divided into separate steel segments disposed next to one another, wherein the steel segments together form a uniform clearing edge close to the ground, wherein the steel segments extend, on the front side and the back side of the rubber body, over an entire height of the rubber body to form front steel segments and back steel segments, and wherein the steel attachment neck extends all the way into the region between the front steel segments and the back steel segments, and wherein the rubber body is vulcanized into the steel attachment neck at a distance from the front steel segments and the back steel segments.

2. The clearing strip according to claim 1, wherein the rubber body is trapezoid in cross-section, with a cross-section that widens from top to bottom.

3. The clearing strip according to claim 1, wherein the rubber body has at least two rubber mixtures with different hardness.

4. The clearing strip according to claim 3, wherein the rubber body has a harder rubber mixture close to the ground than facing away from the ground, in the vertical direction.

5. The clearing strip according to claim 1, wherein the rubber body has at least one cavity.

6. The clearing strip according to claim 5, wherein the at least one cavity in the rubber body runs below and parallel to the lower edge of the steel attachment neck.

7. The clearing strip according to claim 5, wherein the at least one cavity in the rubber body runs vertically.

8. The clearing strip according to claim 5, wherein the at least one cavity has a circular or oval cross-section and extends over the entire height or length of the rubber body.

9. The clearing strip according to claim 5, wherein the at least one cavity is formed as a tubular section embedded in the rubber body.

* * * * *